US005732943A

United States Patent [19]

Delfosse

[11] Patent Number: 5,732,943

[45] Date of Patent: Mar. 31, 1998

[54] METHOD OF SHEET REGISTRATION AND A SHEET STACKER WITH A SHEET REGISTRATION DEVICE

[75] Inventor: Christian Delfosse, Liernu, Belgium

[73] Assignee: C.P. Bourg S.A., Ottignies-Louvain, Belgium

[21] Appl. No.: 675,909

[22] Filed: Jul. 5, 1996

[30] Foreign Application Priority Data

Jun. 17, 1996 [EP] European Pat. Off. ..... 96109712

[51] Int. Cl.[6] ..... B65H 7/02

[52] U.S. Cl. ..... 271/228; 271/270; 271/315; 192/395; 192/456

[58] Field of Search ..... 271/227, 228, 271/270, 315; 198/395, 456

[56] References Cited

U.S. PATENT DOCUMENTS

| | | | |
|---|---|---|---|
| 4,971,304 | 11/1990 | Lofthus . | |
| 5,078,384 | 1/1992 | Moore | 271/228 |
| 5,169,140 | 12/1992 | Wenthe | 271/228 |

FOREIGN PATENT DOCUMENTS

| | | | |
|---|---|---|---|
| 58-167340 | 10/1983 | Japan . | |
| 222626 | 10/1986 | Japan | 198/456 |
| 403528842 A | 5/1991 | Japan | 271/228 |
| 403267244 A | 11/1991 | Japan | 271/228 |

OTHER PUBLICATIONS

Patent Abstracts of Japan, Publication No. 07257799, Oct. 9, 1995, European Patent Office.

Patent Abstracts of Japan, Publication No. JP57195055, Nov. 30, 1982, European Patent Office.

Raymond W. Huggins, "Skew Detector and Method of Correction ",Xerox Disclosure Journal, vol. 14, No. 1, Jan./Feb. 1989, pp. 23–24.

*Primary Examiner*—H. Grant Skaggs

*Attorney, Agent, or Firm*—Sixbey, Friedman, Leedom & Ferguson, P.C.; Gerald J. Ferguson, Jr.

[57] ABSTRACT

To compensate for sheet registration errors and to produce a desired target sheet offset between upstream and downstream positions of a sheet path along which sheets travel successively in a predetermined sheet travel direction, each sheet is driven along the path in at least three successive phases, i.e. a first phase in which the sheet is driven differentially to rotate the sheet in a first direction, a second phase in which the sheet s driven uniformly in the sheet travel direction, and a third phase in which the sheet is driven differentially with a driving velocity versus time profile opposite to that in the first phase, to rotate the sheet in a second direction opposite the first direction. If the sheet has a skew error, an intermediate phase in which the sheet is driven differentially with a driving velocity versus time profile dertmined to correct for the detected skew error, is nested in the second phase.

21 Claims, 8 Drawing Sheets

METHOD OF SHEET REGISTRATION AND A SHEET STACKER WITH A SHEET REGISTRATION DEVICE

The present invention relates to a method of sheet registration between upstream and downstream positions of a sheet path along which sheets travel successively in a predetermined sheet travel direction, and to a sheet stacker with a sheet registration device operating in accordance with the method.

Sheets delivered individually by a printing or copying machine may have a random registration error combined with a random skew error. When the sheets are to be collected for further processing, for example in a booklet binder or in a stacker, they need to be properly aligned. Conventional passive alignment systems rely on physical contact of the sheet edge with stationary alignment members such as side guides. A horizontal stack of paper sheets can be aligned by laterally tapping against the side of the stack. However, physical contact between stationary or movable registration members and a sheet may cause unacceptable damage to the sheet edge. Also, passive alignment systems require a relatively long sheet path to correct for major registration errors of the sheet, and the correcting capacity is limited to registration errors of a few millimeters and skew errors of a few degrees. Further, if sheets in a stack form different sea (or jobs), they must have a different target offset in each set, but tapping on the side edges to assist sheet alignment is excluded.

Active alignment systems are also known. U.S. Pat. No. 4,971,304 discloses an active sheet registration system which provides deskewing and registration of sheets. This system uses a sheet rotator with a pair of laterally spaced sheet driving wheels which drive the sheet differentially to rotate the sheet in opposite directions. During a first period of time a sheet is driven differentially to both compensate for an initial random skew and induce an alignment skew of a predetermined magnitude and direction. During a second period of time, the sheet is driven differentially to compensate for the alignment skew and deskew the sheet, whereby one edge of the sheet is side registered to a lateral position tranverse of the general sheet travel direction.

Another active sheet registration system disclosed in U.S. Pat. No. 5,078,384 also makes use of a sheet rotator with a pair of differentially driven wheels. The initial skew of the sheet is sensed, and the leading edge of the sheet is detected. The sheet is driven differentially in response to the initial skew to remove the skew, and also in response to the detected leading edge to register the leading edge at a predetermined position.

In another active sheet registration system disclosed in U.S. Pat. No. 5,169,140, which is likewise equipped with a sheet rotator having a pair of laterally spaced sheet driving wheels, the sheet is first driven non-differentially in the sheet travel direction, and an initial angle of skew and the side registration error are detected. The sheet is then driven differentially to compensate for the side registration error, thereby inducing a registration angle of skew. The initial angle of skew and the registration angle of skew are summed to determine an absolute angle of skew. Thereafter, the sheet is driven differentially to compensate for the absolute angle of skew so that the sheet is deskewed and one edge of the sheet is side registered.

The present invention provides a method of sheet registration which is capable of accepting centered sheets and delivering centered sheets, and also of correcting an input skew of at least of about 6 degrees and an input registration error, or lateral offset, of about 10 millimeters or more in either direction, without requiring a long sheet registration path and without introducing a delay in the sheet travel.

According to the invention, a method of sheet registration between upstream and downstream positions of a sheet path is provided. The sheets travel successively along the sheet path in a predetermined sheet travel direction. The method comprises the steps of detecting a registration error of a sheet on an upstream side of the sheet path and driving the sheet in at least three successive phases between the upstream and downstream positions. In a first phase the sheet is driven differentially to rotate a sheet in a first direction. In a second phase the sheet is driven uniformly in the sheet travel direction. In a third phase the sheet is driven differentially with a driving velocity versus time profile opposite to that in the first phase, to rotate the sheet in a second direction opposite the first direction. The driving velocity versus time profiles in the first and third phases and the sheet travel distance in the second phase are determined to both compensate for the sheet registration error and produce a predetermined target registration. When the sheet is received with a skew error, an intermediate phase in which the sheet is driven differentially with a driving velocity versus time profile determined to correct for the detected skew error is nested into the second phase. An important feature of the inventive method is that the sheet deskew correction and the side registration correction, or offset generation, are independent of each other so that their effects are orthogonal. Both corrective actions have no influence on each other.

In the preferred embodiment, the sheet is driven along its length with an overall driving velocity versus time profile which is symmetrical with respect to a transverse center line of the sheet. Thus, the sheet is rotated for the purpose of skew correction when its center arrives at the driving wheels.

Still further in the preferred embodiment, the velocity versus time profile in the first and third phases is determined to produce an angle of sheet rotation which is the same within a predetermined range of registration error and target registration, and compensation for the registration error and the target registration are obtained by varying the sheet travel distance in the second phase. Thus, although the sheet is rotated by consistent opposite amounts in the first and third phases of sheet travel, the amount of lateral sheet shift can be precisely determined within a large range. Although the sheets are preferably driven by a pair of driving wheels motorized by step motors, the adjustment of the lateral sheet offset is almost continuous.

The inventive method permits a sheet to be moved along the sheet travel path with a substantially constant velocity component in the travel direction. Therefore, an increased spacing between the sheets is not required.

In accordance with another advantageous feature of the invention, a linear optical detector is used which extends in a direction transverse to the sheet travel direction to derive information on the sheet length and on the sheet registration error. Although, the linear optical detector only senses a limited width of the sheet when the sheet passes over the detector, the detector output contains all required information on the initial skew error and side registration error of the sheet. These parameters can be calculated from the detector output using a microcomputer, based on elementary geometrical relationships. Generally, the particular format of the sheets processed is known. However, the sheet detector can also be used to determine the length of a sheet.

The invention also provides a sheet stacker which comprises a sheet stacking table, a sheet input where individual sheets are successively received with a random registration error, and a sheet registration device which operates in accordance with the above method. The registration device comprises a sheet path along which the sheets travel successively in a predetermined sheet travel direction. A sheet registration error detector is provided on the upstream side of the sheet path. The registration device further comprises a sheet rotator on the sheet path with a pair of sheet driving wheels spaced from each other transversely to the sheet travel direction. Each wheel is motorized by a step motor directly coupled thereto. The step motors are energized to drive the sheet with a driving velocity versus time profile adapted to compensate for a detected registration error and to produce a target sheet registration. Preferably, the driving velocity versus time profile includes a phase of sheet rotation to compensate for a skew error of the sheet. The stacker further comprises a sheet transferring and depositing device which receives the sheets from the sheet rotator with the target registration and deposits the sheets on the stacking table. For the sheet transferring and depositing device, a rotary sheet clamp is preferably used. A rotary sheet clamp is capable of depositing a sheet on the stacking table without introducing any substantial registration error and without inducing static electricity.

Further details and advantages of the present invention will become apparent from the following description in conjunction with the accompanying drawings wherein.

Figure 9:
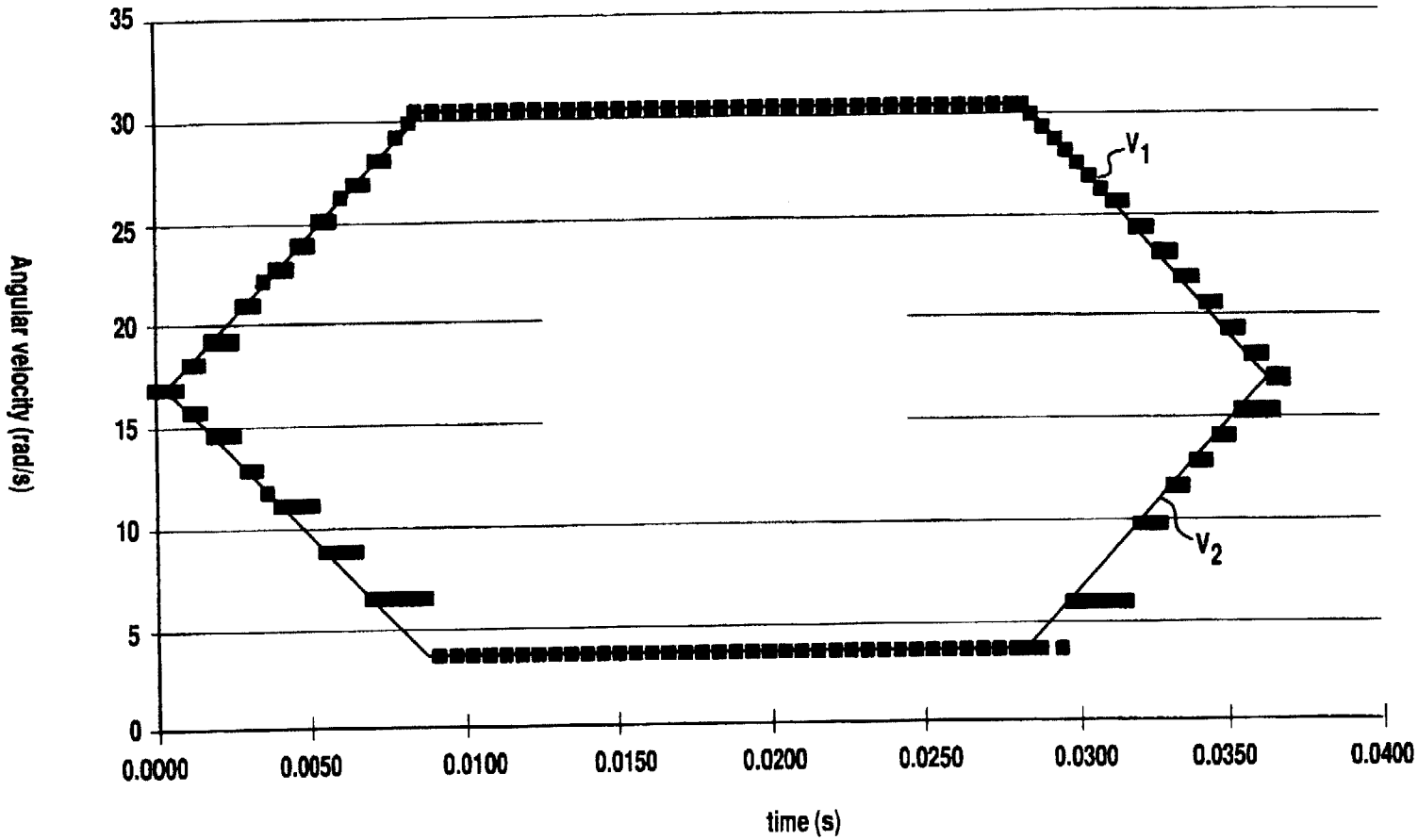

FIGS. *3a*, *3b*, *4a* and *4b* illustrate the principles of a vision system for deriving sheet registration error parameters;

FIGS. *5a–5c* illustrates the operation of the sheet rotator to generate a desired lateral shift of the sheet;

FIGS. *6a–6c* illustrates operation of the sheet rotator to generate both a desired lateral shift and a desired rotation of the sheet;

FIGS. *7a–7b* illustrates the relationship between the amount of lateral shift achieved in dependence upon the length of sheet travel with a first angle of skew;

FIGS. *8a–8b* illustrates a similar relationship for a second skew angle value; and FIG. 9 shows the velocity versus time profile in a particular phase of sheet travel.

Figure 1:
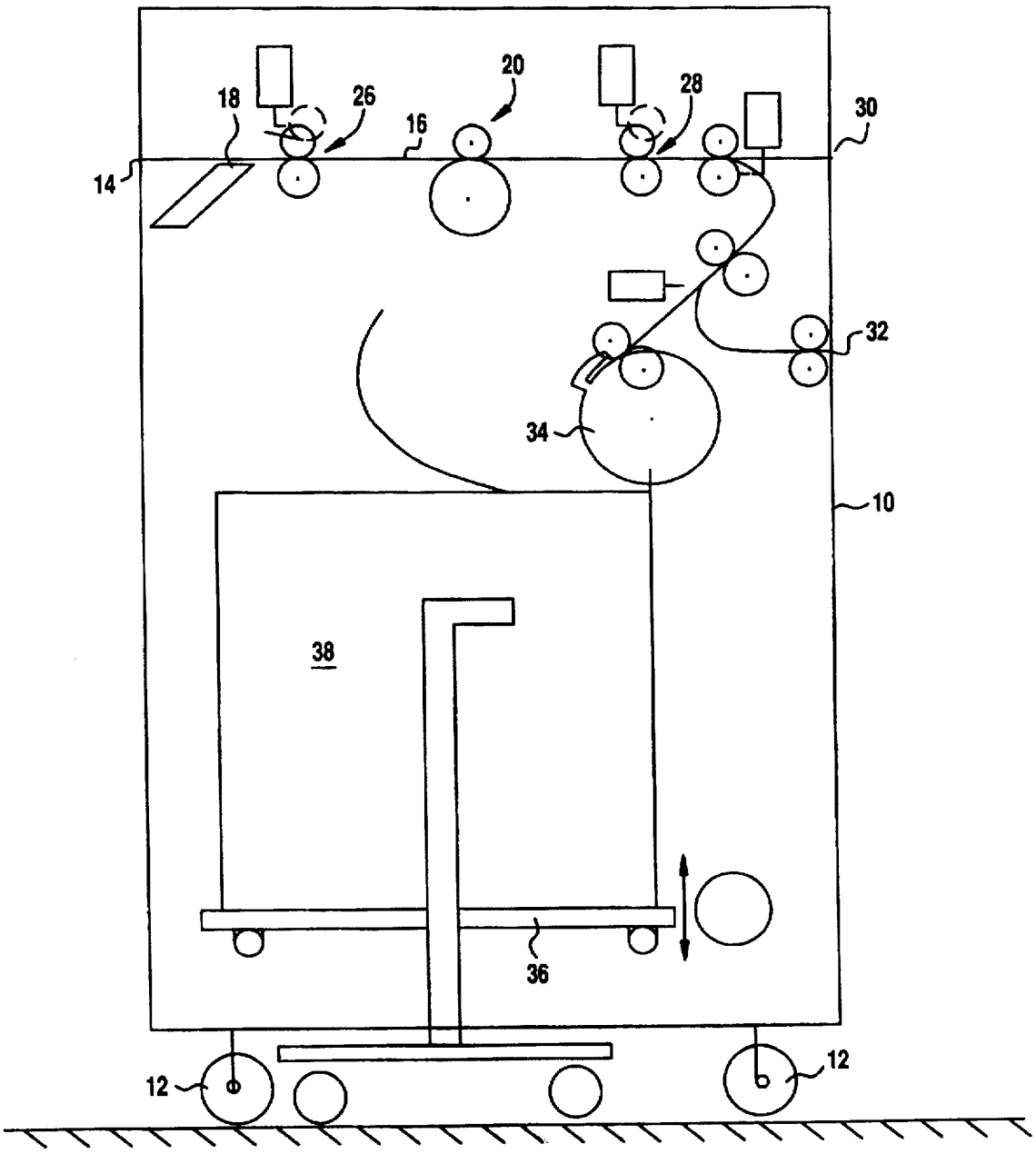
FIG. 1 is a schematic sectional view of a sheet stacker.

Referring now to FIG. 1 of the drawings, a sheet stacker is accomodated in a machine frame 10 mounted on castors 12. On its front side, the machine frame 10 has a sheet inlet 14, and a horizontal sheet travel path 16 extends from sheet inlet 14. An optical scanner 18 which may comprise a linear optical detector array, is arranged below the sheet travel path 16 close to sheet inlet 14. A sheet rotator generally indicated at 20 is provided on the sheet travel path 16. The sheet rotator 20 comprises a pair of laterally spaced sheet driving wheels 22, 24 (see FIG. 2) arranged below the sheet travel path 16 and a pair of correspondingly laterally spaced counterwheels 22*a*, 24*a*. Upstream and downstream from the sheet rotator 20 are driving roller pairs 26 and 28, the upper roller of which can be selectively lifted. Downstream from the sheet rotator, the sheets are selectively gated to a first sheet outlet 30 which is horizontally aligned with sheet inlet 14, to a second sheet outlet 32 on a level lower than that of sheet outlet 30, or to a rotary sheet clamp 34. A vertically movable stacking table 36 is provided at the bottom of machine frame 10. As shown in FIG. 1, sheets received by the rotary clamp 34 from the sheet rotator 20 are deposited on a stack 38 of sheets accumulated on the stacking table 36. The rotary clamp is able to deposit the sheets on the stack 38 without introducing any substantial registration error and without inducing static electricity.

Figure 2:
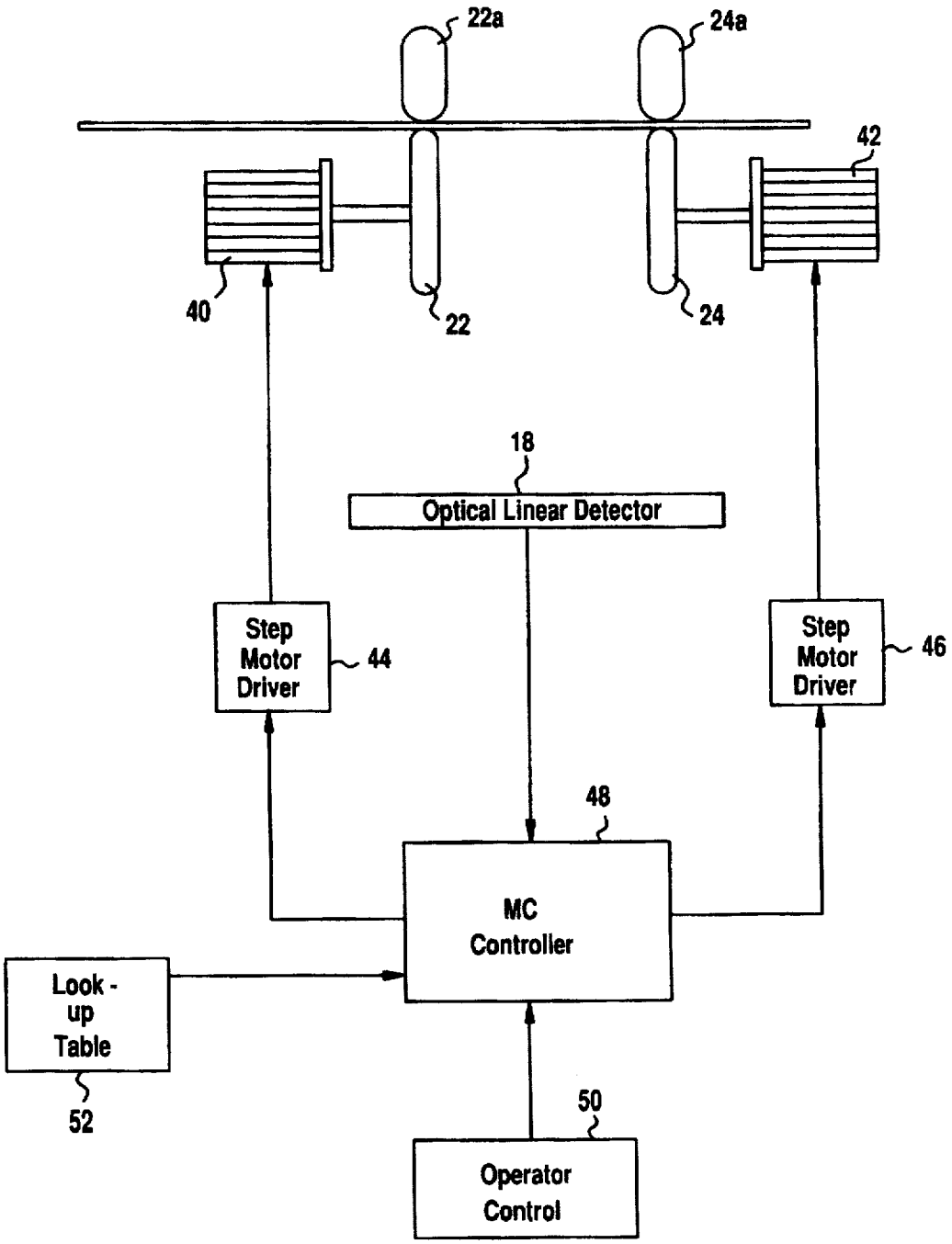
FIG. 2 is a schematic view of a sheet rotator and associated control circuitry used in the sheet stacker.

As seen in FIG. 2, each of the driving wheels 22, 24 is directly coupled to an associated step motor 40, 42. Step motors 40, 42 are connected to step motor drivers 44, 46, respectively, which are both connected to a microcomputer controller 48. An operator control panel 50 can be connected to controller 48, as shown. Also seen in FIG. 2 is a programmable memory 52 forming a lookup table which is connected to controller 48. The purpose of the lookup table will become apparent from the following description of the inventive method. A further input to the controller 48 is provided by the optical scanner 18.

Referring now to FIG. *3a*, when a sheet S is received at sheet inlet 14 in the general sheet travel direction indicated by an arrow F, it passes over optical scanner 18, the output of which is provided to controller 48. Optical scanner 18 senses only a fraction of the width of each sheet. Therefore, as seen in FIG. *4a*, the optical scanner 18 can "see" only a portion of the sheet edges. Normally, each sheet will be received with a random angle of skew with respect to the travel direction F, and with a random side offset d with respect to a lateral reference line R of the sheet travel path. If the size of the sheet is known, it is easy for controller 48 to derive from the output of optical scanner 18 the sheet registration error, i.e. the skew error $\alpha$ and the side registration error d. The controller 48 uses elementary geometrical relationships to derive these error parameters from the output of optical scanner 18. In FIGS. *3b* and *4b* the sheet S has an angle of skew in a sense opposite to that in FIGS. *3a* and *4a*, and two corners of the sheet are "seen" by the optical scanner 18, although this is not a requirement.

Figure 5A:
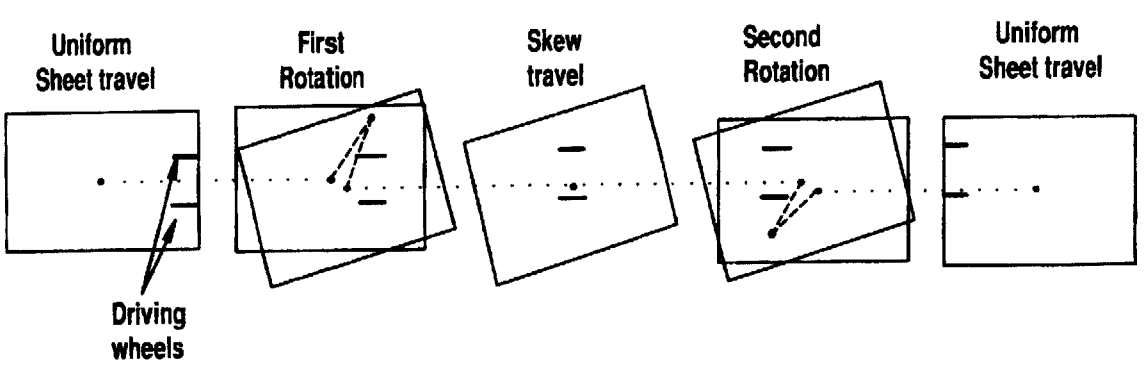
Figure 5B:
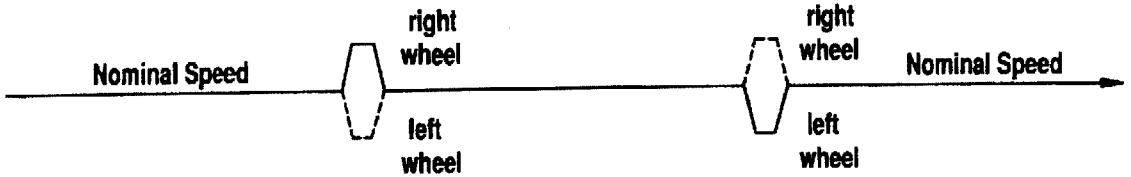
Figure 5C:
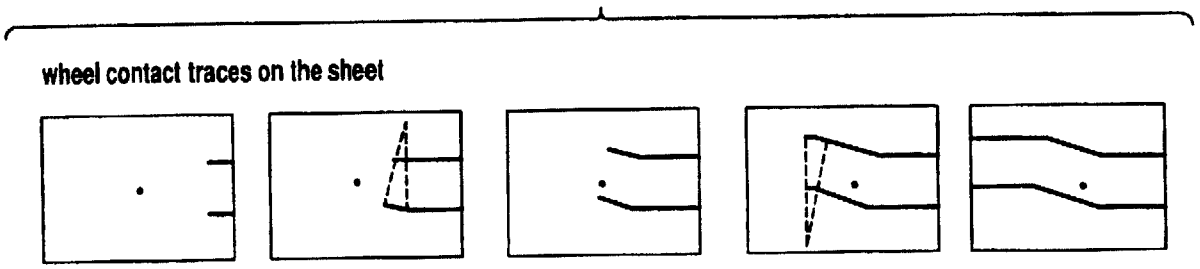

With reference to FIG. 5, travel of sheet S is illustrated from an upstream position close to sheet inlet 14 to a downstream position close to sheet outlet 30. The relative position of the driving wheels 22, 24 on the sheet S is represented by a pair of laterally spaced dark lines in FIG. *5a*, and the traces of the contact point of wheels 22, 24 on the sheet are marked in FIG. *5c*.

Subsequent to an initial phase of uniform sheet travel, the sheet is rotated for a first time about a center of rotation $R_1$ which lies on the common axis of the driving wheels and outside of the space between these wheels on a first side. Due to this rotation, the center C of the sheet is shifted laterally .away from the center of rotation $R_1$. Rotation of the sheet S is achieved by differentially driving wheels 22, 24 in accordance with a driving velocity versus time profile represented in FIG. *5b*. As is seen in the diagram of FIG. *5b*, the velocity of the wheel on the right hand side in the direction of travel is momentarily accelerated by the same amount as the driving wheel on the left hand side is slowed down. In the diagram, the continuous line refers to the driving wheel on the right hand side, and the chained line refers to the wheel on the left hand side. Details of this first phase of differential driving will be explained later with reference to FIG. 9.

After this initial phase of rotation, the sheet is uniformly driven with an angle of skew resulting from the rotation in the preceding phase (if the sheet is initially received without a skew error). Thereafter, the sheet is given a second rotation in a sense opposite to the first rotation, but of a like amount, about a center of rotation $R_2$ located on the side opposite to the center of first rotation $R_1$. As is seen in FIG. *5a*, the center of the sheet is now shifted towards the center of rotation $R_2$, and the sheet has an orientation parallel to that in which it was initially reveived, but with a lateral shift from the initial position. The amount of the lateral shift, or offset, is determined both to compensate for an initial side registration error and to achieve a preselected lateral target registration for the sheet.

Figure 3A:
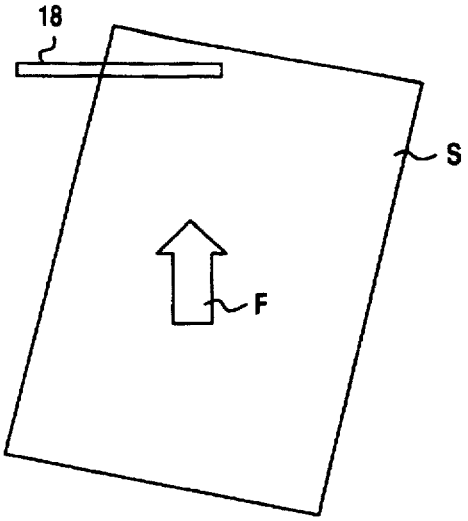
Figure 4A:
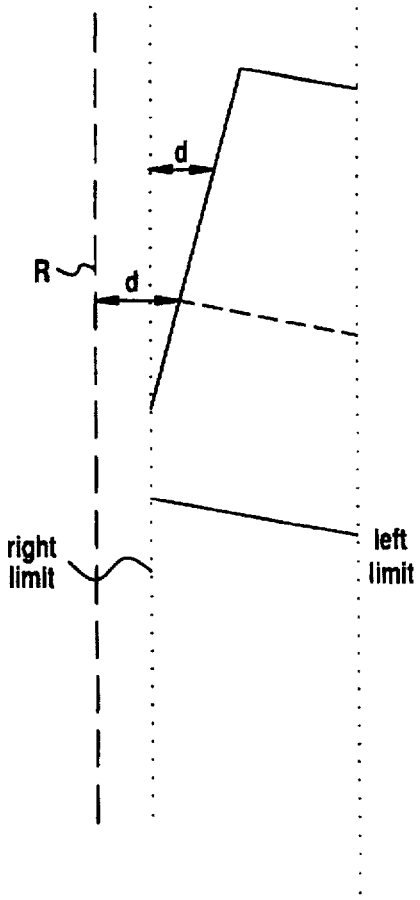
Figure 3B:
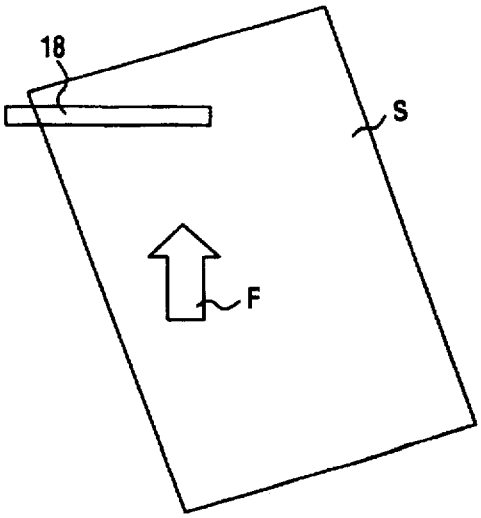
Figure 4B:
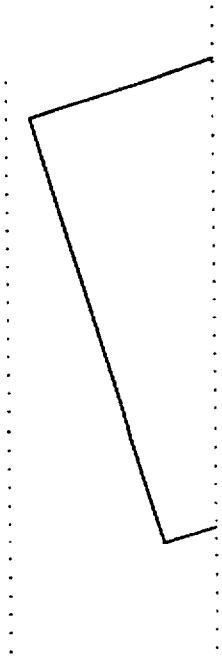
Figure 6A:
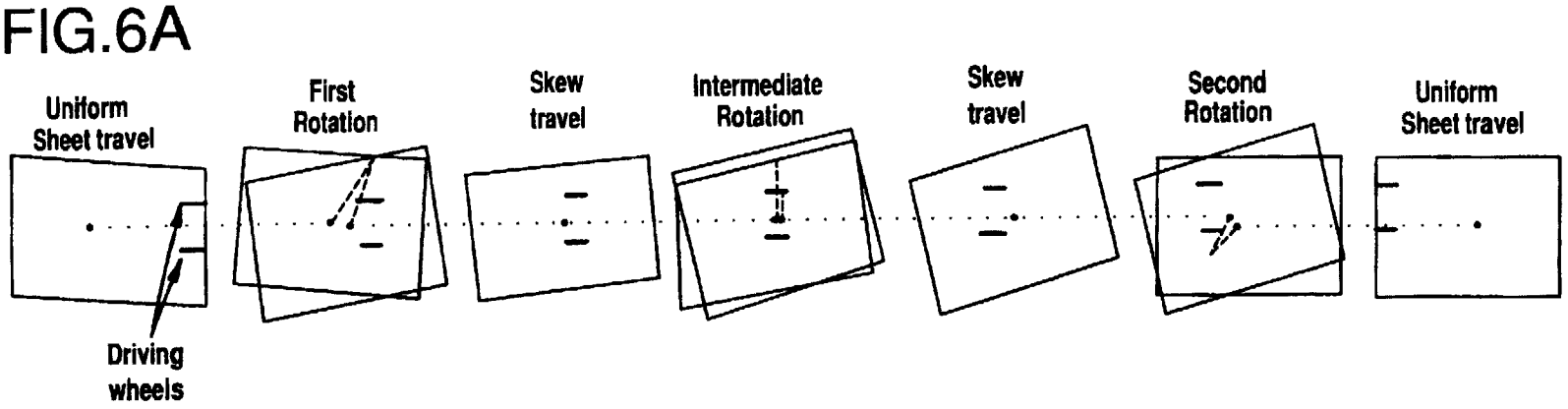
Figure 6B:
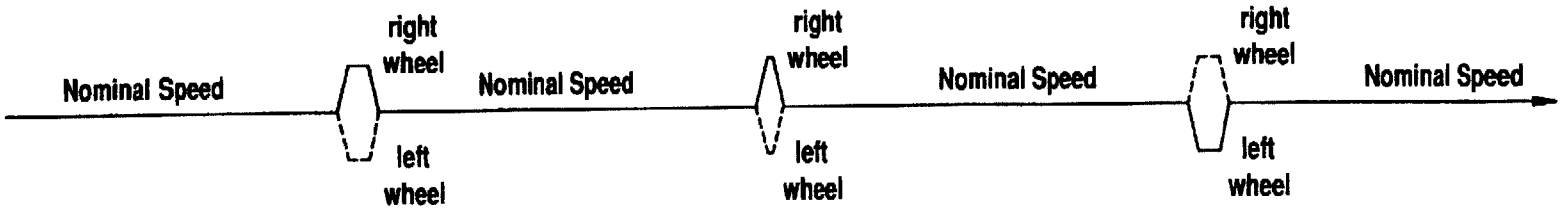
Figure 6C:
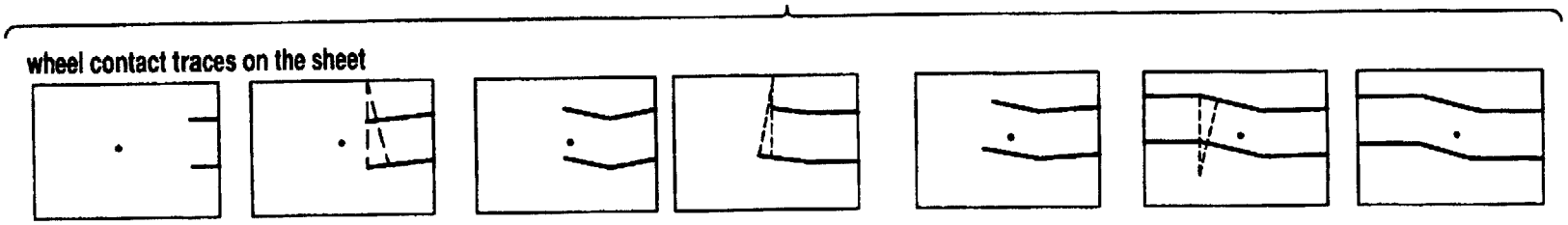

When the sheet S is received with a skew error, as shown in FIG. 6, a phase of intermediate rotation is nested in the phase of uniform travel between the first and second rotations. In this intermediate phase of rotation, the sheet is rotated by an amount equal to the detected error of skew, but in an opposite sense, to compensate for the error of skew. An important aspect of the method is that rotation of the sheet for the purpose of skew compensation is independent of the first and second rotations the only purpose of which is to achieve the desired lateral target registration. Another important aspect is that the global profile of velocity versus time for the driving wheels 22, 24 is symmetrical with respect to the transverse center line of the sheet, thereby enabling the step motors 40, 42 to be consistently driven with the maximum mount of acceleration compatible with the available driving torque, the weight of the sheets to be handled and the requirement of avoiding slippage of the sheets between the driving wheels 22, 24 and the counterwheels 22*a*, 24*a*. As is also seen in FIGS. 5 and 6, the sheet passing through the sheet rotator is not globally slowed down; it is moved along the sheet travel path 16 with a constant velocity component in the general travel direction (F in FIG. 3). Therefore, the spacing between successive sheets received in the sheet rotator must not be increased.

In order to permit free rotation of the sheet, the upper driving rollers 26 and 28 are momentarily lifted. The driving rollers 26, 28 are only required if relatively short sheets are to be handled. In fact, the total length of the horizontal sheet travel path 16 is not much more than the length of the longest sheet to be handled, for example not more than 200 or, preferably, 150 millimeters.

FIGS. 7 and 8 illustrate the impact of the particular driving velocity versus time profile at the driving wheels 22, 24 on the amount of lateral sheet offset achieved.

The velocity profiles in FIGS. 7 and 8 indicate a maximum sheet travel distance from the beginning of the first rotation to the end of the second rotation, and a minimum sheet travel distance between the end of the first and the beginning of the second rotation. The maximum sheet travel distance is of course dependent on the length of the longest sheet to be handled. The minimum sheet travel distance is determined by the maximum amount of deskew angle to be achieved for the shortest sheet to be handled since the intermediate deskew rotation occurs between the phases of first and second rotation.

As apparent from FIG. 7, a maximum lateral sheet offset is achieved for an angle B of rotation when the travel distance between the first and second phases of rotation is maximum, and a minimum lateral sheet offset is achieved when the travel distance between the first and second rotations is maximum.

Figure 7A:
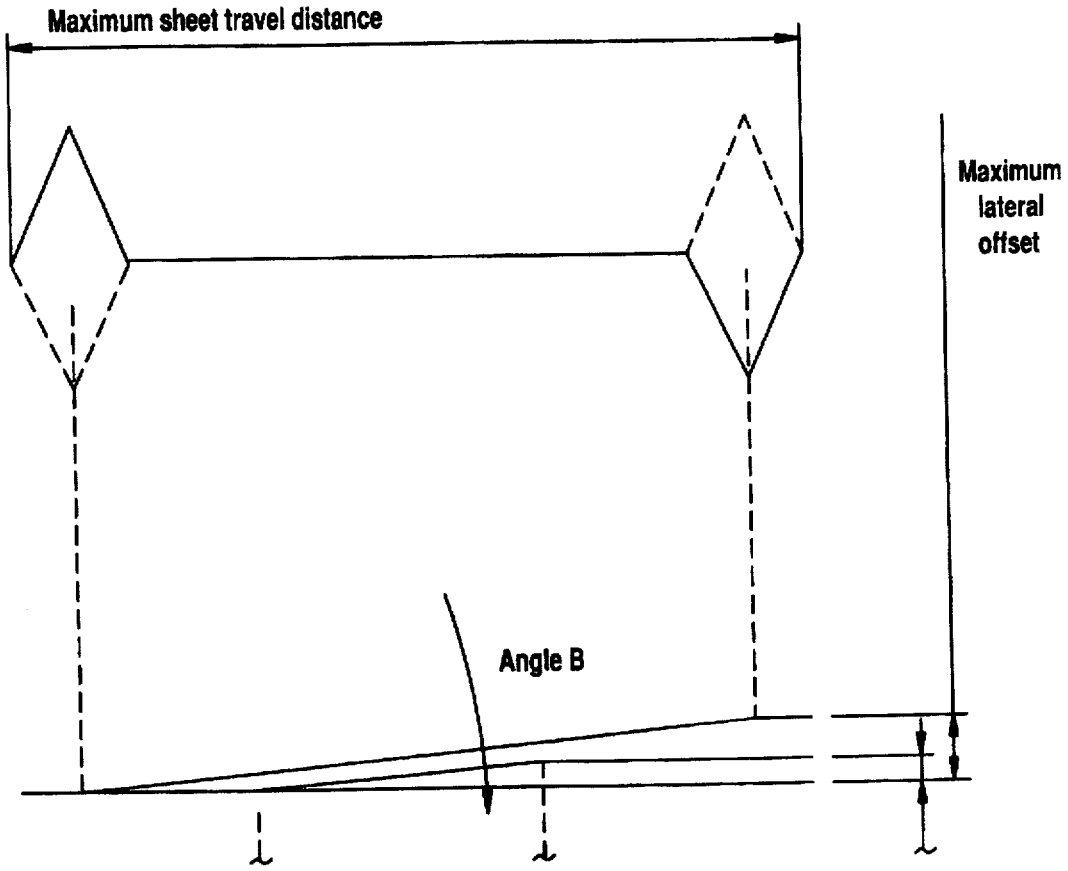
Figure 7B:
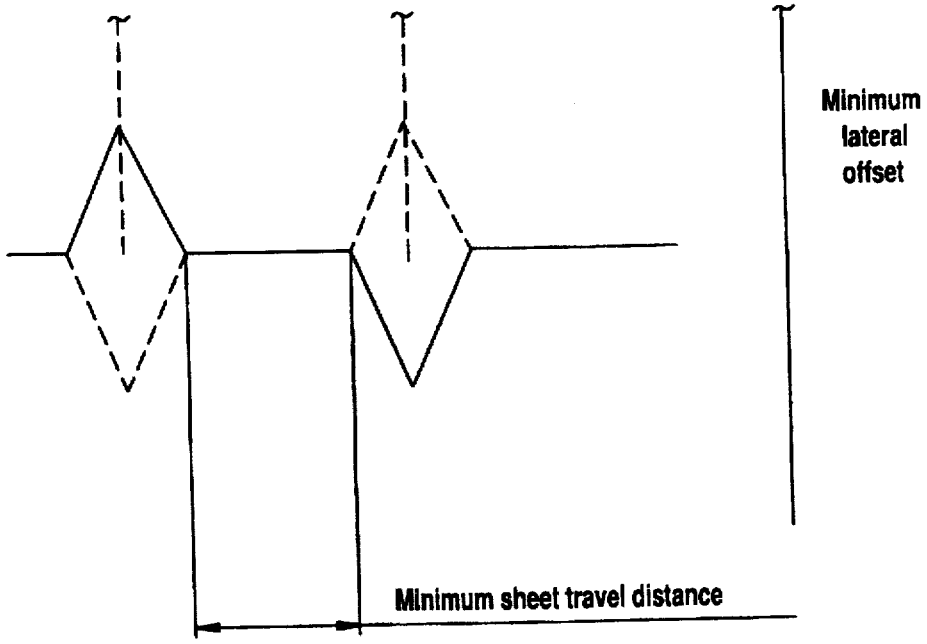
Figure 8A:
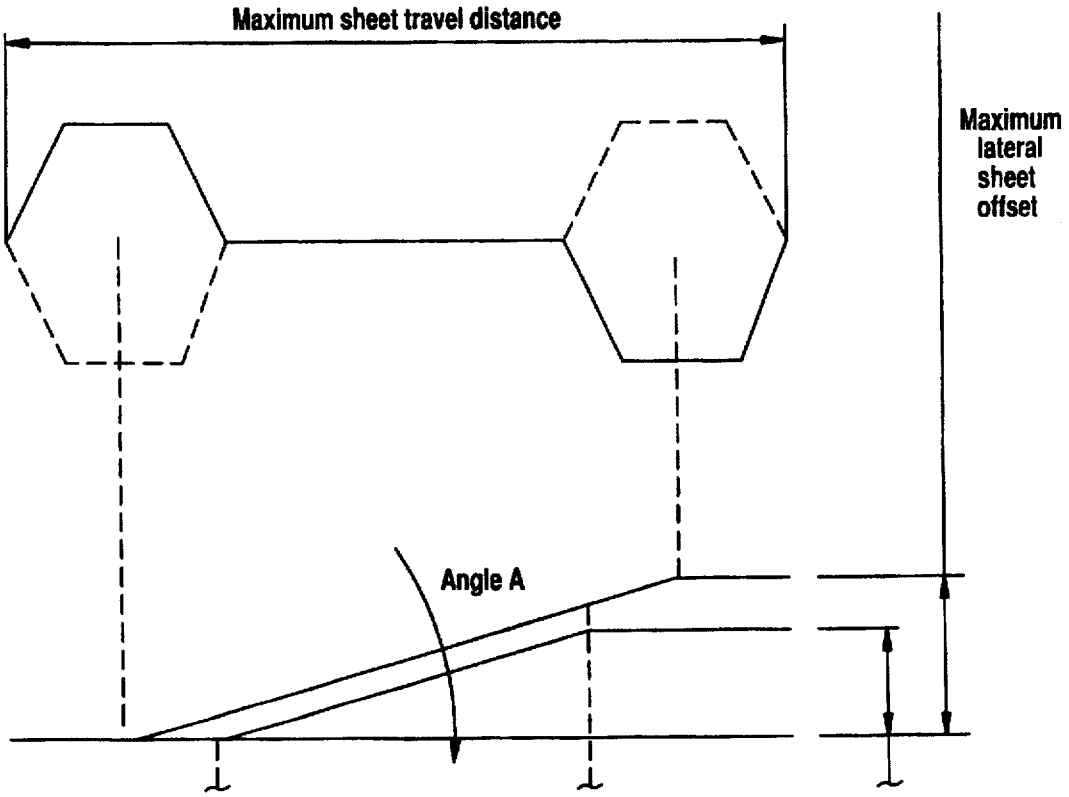
Figure 8B:
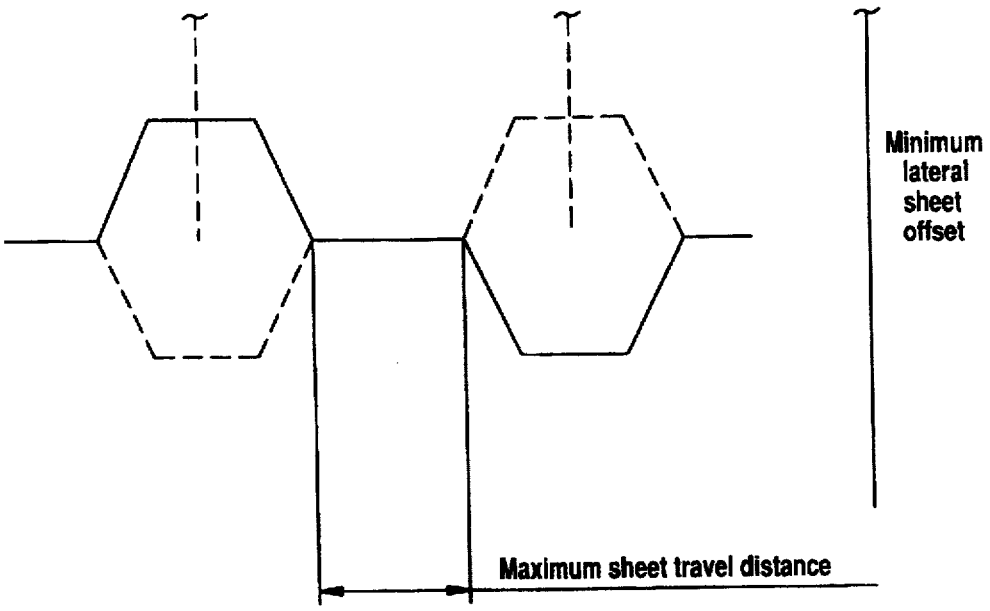

For a minimum amount of the angle B of rotation at a predetermined maximum acceleration and deceleration of the step motors, the velocity profile has a constant rising or descending slope with a peak and an opposite slope thereafter, as shown in FIGS. 7*a* and 7*b*. A greater angle A of rotation is achieved with the same maximum acceleration or deceleration of the step motors when the velocity is kept constant during a time interval between the rising and descending parts of the profile, as shown in FIGS. 8*a* and 8*b*. Obviously, with a greater value of the rotation angle A, correspondingly greater amounts of lateral sheet offset are achieved, as also indicated in FIGS. 8*a* and 8*b*.

For consistent conditions of rotation, it is useful to operate with the same angle of rotation for the first and second rotations independent of the amount of lateral offset to be achieved, or with a few discrete values for the angle of rotation, such as the angles A and B in FIGS. 7 and 8. A remarkable feature of the method is that the sheet offset is nevertheless varied almost continuously by varying the sheet travel distance between the end of the first and the beginning of the second rotation. Also, if an intermediate deskew rotation is nested centrally within the velocity profiles of FIGS. 7 and 8, this will have no influence on the amount of lateral sheet offset. Conversely, the travel distance of the sheet between the first and second rotations will have no influence on the deskew correction achieved with the intermediate rotation centrally nested in the velocity profile.

To achieve registration with high accuracy, the incremental steps of motors 40, 42 should be small, and a high-speed controller 48 is required. To reduce the performance requirements on the controller 48, the lookup table 52 (FIG. 2) is used. The lookup table 52 contains a programmed table of timing data for control of the step motor drivers 44, 46 in dependence upon the required sheet offset to be achieved for a particular amount of sheet rotation, or a set of such timing data for different discrete angles of rotation in the first and second phases.

The diagram in FIG. 9 illustrates in more detail the phase of first sheet rotation. The diagram shows a velocity profile, i.e. a diagram showing the angular velocity $v_1$ for the first driving wheel 22 and the angular velocity $v_2$ for the second driving wheel 24 as a function of time. Since the driving motors 40 and 42 used are step motors, the velocity profile cannot be continuous, and is actually composed of discrete incremental steps. To avoid a tilting movement of the sheet during rotation, i.e. to make rotation substantially monotonous, the incremental steps of both motors are synchronized to the extent possible.

The particular velocity profile of FIG. 9 consists of a first part where the velocity $v_1$ is rising and the velocity $v_2$ is decreasing, a second part where the velocities $v_1$ and $v_2$ are different but constant, and a third part where the velocity $v_1$ decreases and the velocity $v_2$ increases. Throughout the first, second and third parts of this profile, the sheet is driven "differentially", i.e. the driving wheels 22, 24 rotate at different speeds so that the sheet is rotated.

If desired, the sheets on stacking table 36 can be stacked with a lateral registration differing after a preselected number of sheets, to provide so-called offset jobs.

I claim:

1. A method of sheet registration between upstream and downstream positions of a sheet path along which sheets travel successively in a predetermined sheet travel direction, comprising the steps of:

detecting a registration error of a sheet on an upstream side of said sheet path;

driving said sheet in at least three successive phases between said upstream and downstream positions with a first phase in which the sheet is driven differentially to rotate the sheet in a first direction, a second phase in which the sheet is driven uniformly in the sheet travel direction, and a third phase in which the sheet is driven differentially with a driving velocity versus time profile opposite to that in the first phase, to rotate the sheet in a second direction opposite the first direction;

the driving velocity versus time profiles in said first and third phases and the sheet travel distance in said second phase being determined to both compensate for said registration error and produce a predetermined target registration.

2. The method of claim 1, wherein the sheet is driven along its length with an overall driving velocity versus time profile which is symmetrical with respect to a line in a diagram representing said profile, said line being parallel to a velocity axis in said diagram.

3. The method of claim 1, wherein the velocity versus time profile in the first and third phases is determined to produce an angle of sheet rotation which is the same within a predetermined range of registration error and target registration, compensation for the registration error and the, target registration being obtained by varying the sheet travel distance in the second phase.

4. The method of claim 1, wherein the sheet is moved between said upstream and downstream positions of the sheet path with a substantially constant velocity component in the sheet travel direction.

5. The method of claim 1, wherein sheet rotation is at least substantially monotonous.

6. The method of claim 1, wherein the sheets are driven between the upstream and downstream positions by a pair of wheels spaced from each other transversely to the sheet travel direction, each pair of wheels being motorized by a step motor directly coupled thereto.

7. The method of claim 6, wherein the step motors are energized with incremental steps which are substantially synchronized between the motors.

8. The method of claim 1, wherein a linear optical detector extending in a direction transverse to the sheet travel direction is used to derive information on the sheet length and on the sheet registration error.

9. A method of sheet registration between upstream and downstream positions of a sheet path along which sheets travel successively in a predetermined sheet travel direction, comprising the steps of:

detecting a registration error of a sheet on an upstream side of said sheet path;

detecting a skew error of a sheet on the upstream side of the sheet path;

driving said sheet in at least three successive phases between said upstream and downstream positions with a first phase in which the sheet is driven differentially to rotate the sheet in a first direction, a second phase into which an intermediate phase is nested, the sheet in said intermediate phase being driven differentially in the sheet travel direction with a driving velocity versus time profile determined to correct for the detected skew error, and, between the beginnings of the second and intermediate phases and between the ends of the intermediate and second phases, being driven uniformly in the sheet travel direction, and a third phase in which the sheet is driven differentially with a driving velocity versus time profile opposite to that in the first phase, to rotate the sheet in a second direction opposite the first direction;

the driving velocity versus time profiles in said first and third phases and the sheet travel distance in said second phase being determined to both compensate for said registration error and produce a predetermined target registration.

10. The method of claim 9, wherein the sheet is driven along its length with an overall driving velocity versus time profile which is symmetrical with respect to a line in a diagram representing said profile, said line being parallel to a velocity axis in said diagram.

11. The method of claim 9, wherein the velocity versus time profile in the first and third phases is determined to produce an angle of sheet rotation which is the same within a predetermined range of registration error and target registration, compensation for the registration error and the target registration being obtained by varying the sheet travel distance in the second phase.

12. The method of claim 9, wherein the sheet is moved between said upstream and downstream positions of the sheet path with a substantially constant velocity component in the sheet travel direction.

13. The method of claim 9, wherein sheet rotation is at least substantially monotonous.

14. The method of claim 9, wherein the sheets are driven between the upstream and downstream positions by a pair of wheels spaced from each other transversely to the sheet travel direction, each pair of wheels being motorized by a step motor directly coupled thereto.

15. The method of claim 14, wherein the step motors are energized with incremental steps which are substantially synchronized between the motors.

16. The method of claim 9, wherein a linear optical detector extending in a direction transverse to the sheet travel direction is used to derive information on the sheet length and on the sheet registration error.

17. A sheet stacker comprising a sheet stacking table, a sheet input where individual sheets are successively received with a random registration error, and a sheet registration device operating in accordance with the method of claim 1 or 9, said registration device comprising a sheet travel path along which the sheets travel successively in a predetermined sheet travel direction, a sheet registration error detector on the upstream side of the sheet travel path, a sheet rotator on the sheet travel path with a pair of sheet driving wheels spaced from each other transversely of the sheet travel direction, each wheel being motorized by a step motor directly coupled thereto said step motors being energized to drive the sheet with a driving velocity versus time profile adapted to compensate for a detected registration error and to produce a target sheet registration, and a sheet transferring and depositing device receiving the sheets from the sheet rotator with the target registration and depositing the sheets on the stacking table.

18. The sheet stacker of claim 17, wherein said sheet transferring and depositing device comprises a rotary sheet clamp.

19. The sheet stacker of claim 17, wherein said sheet registration device comprises a pair of driving rollers upstream of said pair of wheels and a pair of driving rollers downstream of said pair of wheels, each pair of driving rollers having one roller that is selectively retracted from the other when a sheet is differentially driven by said pair of wheels.

20. The sheet stacker of claim 17, wherein said sheet registration device alternatively produces either of two different target registrations for a predetermined number of sheets.

21. The sheet stacker of claim 17, wherein said sheet travel path has a total length exceeding the length of the longest possible sheet to be handled by not more than about 20 cm, preferably 15 cm.

* * * * *